United States Patent [19]

Hoglund, Jr.

[11] Patent Number: 4,536,991

[45] Date of Patent: Aug. 27, 1985

[54] WORKTABLE WITH LATERAL AND ROTATIONAL MOVEMENT

[75] Inventor: Nils O. Hoglund, Jr., Berkeley Heights, N.J.

[73] Assignee: Hoglund Tri-Ordinate Corporation, Berkeley Heights, N.J.

[21] Appl. No.: 514,505

[22] Filed: Jul. 18, 1983

[51] Int. Cl.[3] ..... B24B 17/02

[52] U.S. Cl. ..... 51/101 R; 51/217 A; 51/237 R; 51/240 A; 269/11

[58] Field of Search ..... 51/97 NC, 101 R, 105 EC, 51/217 R, 217 A, 236, 237 R, 240 R, 240 T, 240 A, DIG. 32; 269/58, 60, 71, 104, 111, 113, 114, 118, 119, 246; 279/1 L

[56] References Cited

U.S. PATENT DOCUMENTS

| | | | |
|---|---|---|---|
| 2,207,342 | 7/1940 | Eastus | 269/114 X |
| 2,416,703 | 3/1947 | Marshall | 51/217 A X |
| 3,663,188 | 5/1972 | Hoglund | 51/DIG. 32 |
| 3,849,857 | 11/1974 | Murray | 269/60 |
| 4,292,699 | 10/1981 | Szabo | 51/240 R X |

*Primary Examiner*—Robert P. Olszewski

*Attorney, Agent, or Firm*—Pennie & Edmonds

[57] ABSTRACT

A worktable comprises upper and lower members that fit together in sliding relation with a rectangular extension of the upper member protruding into a recess in the lower member. The recess is larger than the extension so as to permit the upper member to slide across the surface between the upper and lower members. Eight adjustment screws are mounted in opposing pairs in the lower member so that each pair bears on a different side of the extension. By backing off on some screws while advancing others, the upper member of the worktable may be moved with respect to the lower member to adjust the position of the workpiece with respect to the grinding wheel. The use of pairs of opposing adjustment screws permit both rectilinear movement of the upper member depending on the amount of advancement of each pair of screws and rotational movement when the screws in each pair are advanced by different amounts.

4 Claims, 5 Drawing Figures

FIG. 3
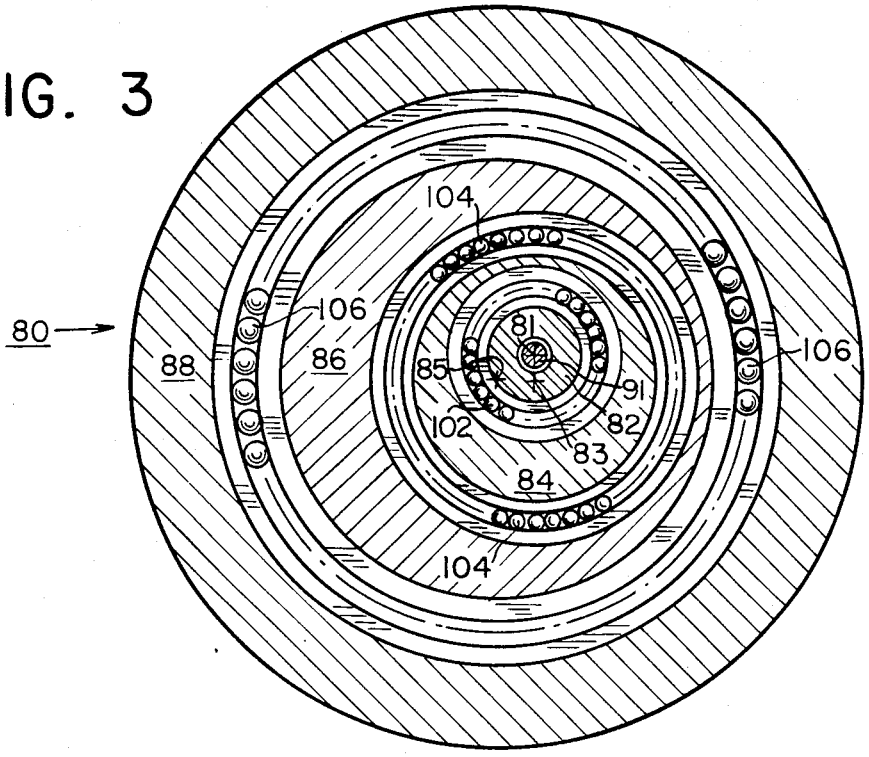
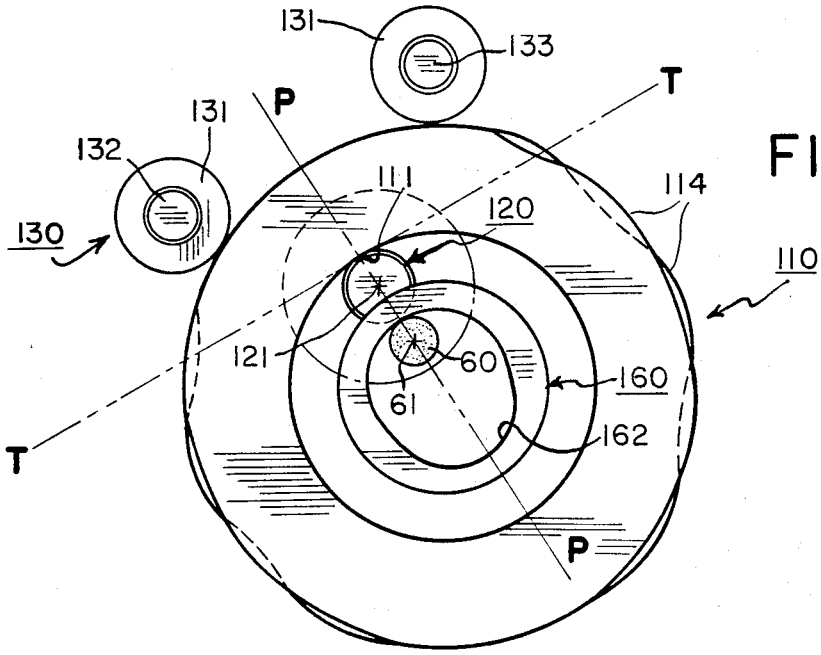
FIG. 4

WORKTABLE WITH LATERAL AND ROTATIONAL MOVEMENT

CROSS-REFERENCE TO RELATED APPLICATION

A related application is Cam Controlled Machine for Forming Non-Standard Surfaces, Ser. No. 514,512 filed simultaneously herewith and assigned to the same assignee. Such application is incorporated herein by reference.

BACKGROUND OF THE INVENTION

The present invention relates to a worktable that provides for both lateral and rotational movement. While a worktable having such movements may be used in numerous applications, it is especially useful with apparatus such as the cam controlled grinding machine of the cross-referenced application in which a workpiece is subjected to both rotational and lateral movement during a grinding operation. In such a device there is frequent need for making both lateral and rotational alignment adjustments in workpieces mounted on the worktable. Accordingly, the invention will be described in terms of an element of such a grinding machine.

SUMMARY OF THE INVENTION

In an illustrative embodiment of the invention, the worktable comprises upper and lower members that fit together in sliding relation with an extension of the upper member protruding into a recess in the lower member. The recess is larger than the extension so as to permit the upper member to slide across the surface between the upper and lower members. Eight adjustment screws are mounted in pairs in the lower member so as to bear on the extension and thereby secure the upper member of the worktable in a position relative to the lower member. By backing off on some screws while advancing others, the upper member of the worktable may be moved with respect to the lower member to adjust the position of the workpiece with respect to the grinding wheel. By using pairs of opposing adjustment screws, the upper member may be moved rectilinearly depending on the amount of advancement of each pair of screws and it may be rotated when the screws in each pair are advanced by different amounts.

BRIEF DESCRIPTION OF THE DRAWINGS

These and other objects, features and advantages of the invention will be more readily apparent from the following detailed description of a preferred embodiment of the invention in which:

FIG. 3 is a cross-sectional view of support means 80 taken along lines 3—3 of FIG. 1;

FIG. 4 is a schematic illustration depicting the relation of certain elements of the embodiment of FIGS. 1 and 2.

DETAILED DESCRIPTION OF PREFERRED EMBODIMENTS OF THE INVENTION

Figure 1:
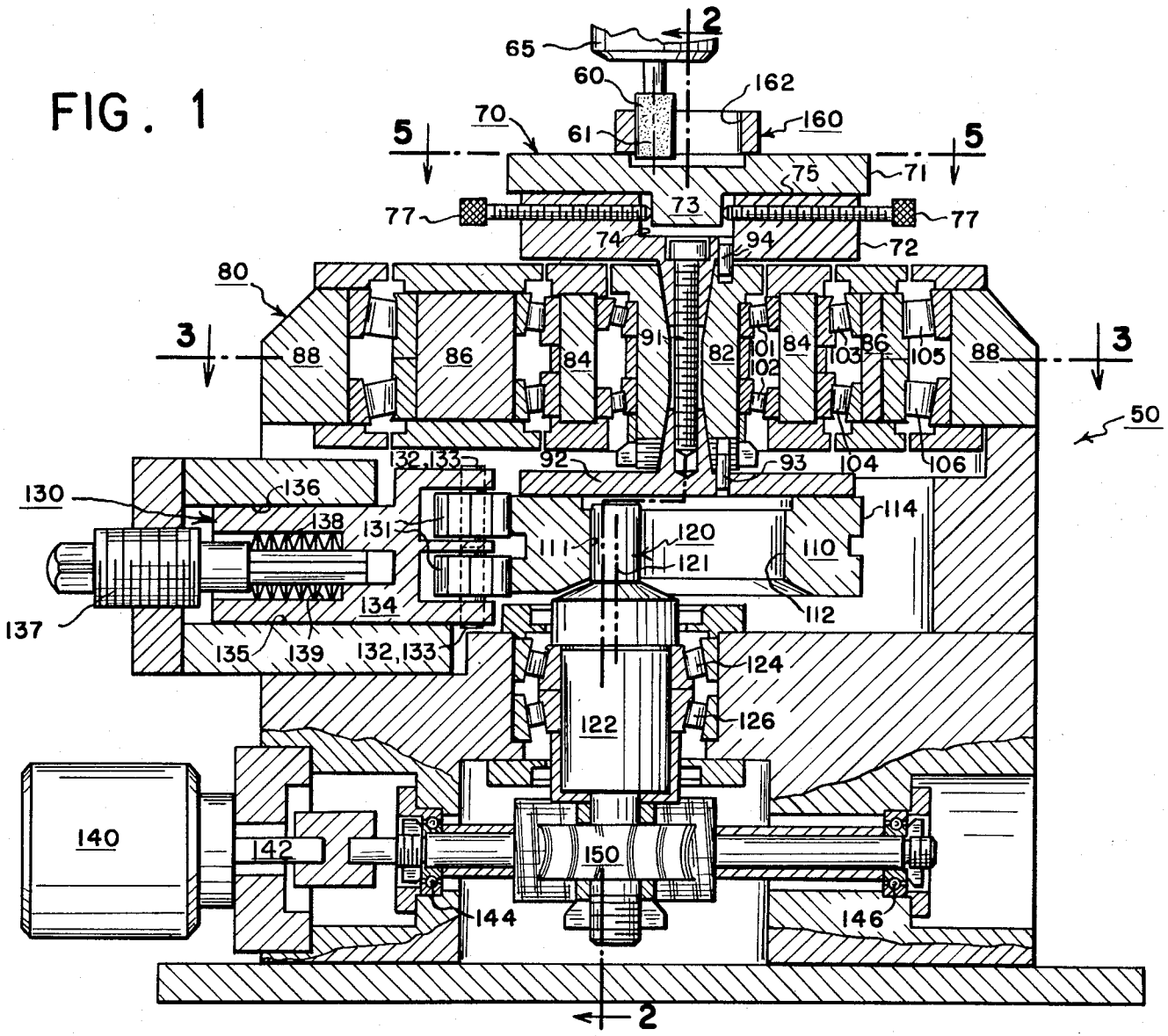
FIG. 1 is a cross-sectional view of an illustrative embodiment of a grinding machine in which the invention may be practiced.

As shown in FIGS. 1–4, an illustrative grinding apparatus 50 in which the invention is practiced comprises a grinding wheel 60, a grinding wheel drive motor 65, a support means 80, an annular cam member 110, a cam drive follower 120, a cam guide follower 130, a drive motor 140, a coupling means 150 for connecting drive motor 140 to cam drive follower 120, and a worktable 70 of the present invention. Illustratively, cam drive follower 120 is mounted on a spindle 122 that is supported for rotation about axis 121 by upper and lower roller bearing arrays 124, 126. Illustratively, coupling means 150 is a worm gear that is driven by an output shaft 142 from motor 140. As shown in FIG. 1, shaft 142 is mounted in ball bearing arrays 144, 146.

Cam drive follower 120 engages an inner surface 112 of cam member 110 at point 111 and cam guide follower means 130 engages an outer surface 114 of the cam member to urge the inner surface into contact with follower 120. Advantageously, outer surface 114 is formed in two tracks of different contour as shown in FIG. 4; and cam guide follower means 130 is a pair of rotatable wheels 131 each of which engages one of these tracks. The wheels are mounted on axles 132, 133 in a frame member 134 that is slidably mounted between surfaces 135, 136 within a recess in grinding apparatus 50. The pressure of the cam guide follower means 132 on surface 114 can be adjusted by means of a threaded screw and shaft 137 that bear on a spring 138 within a recess 139 in frame 134.

Figure 2:
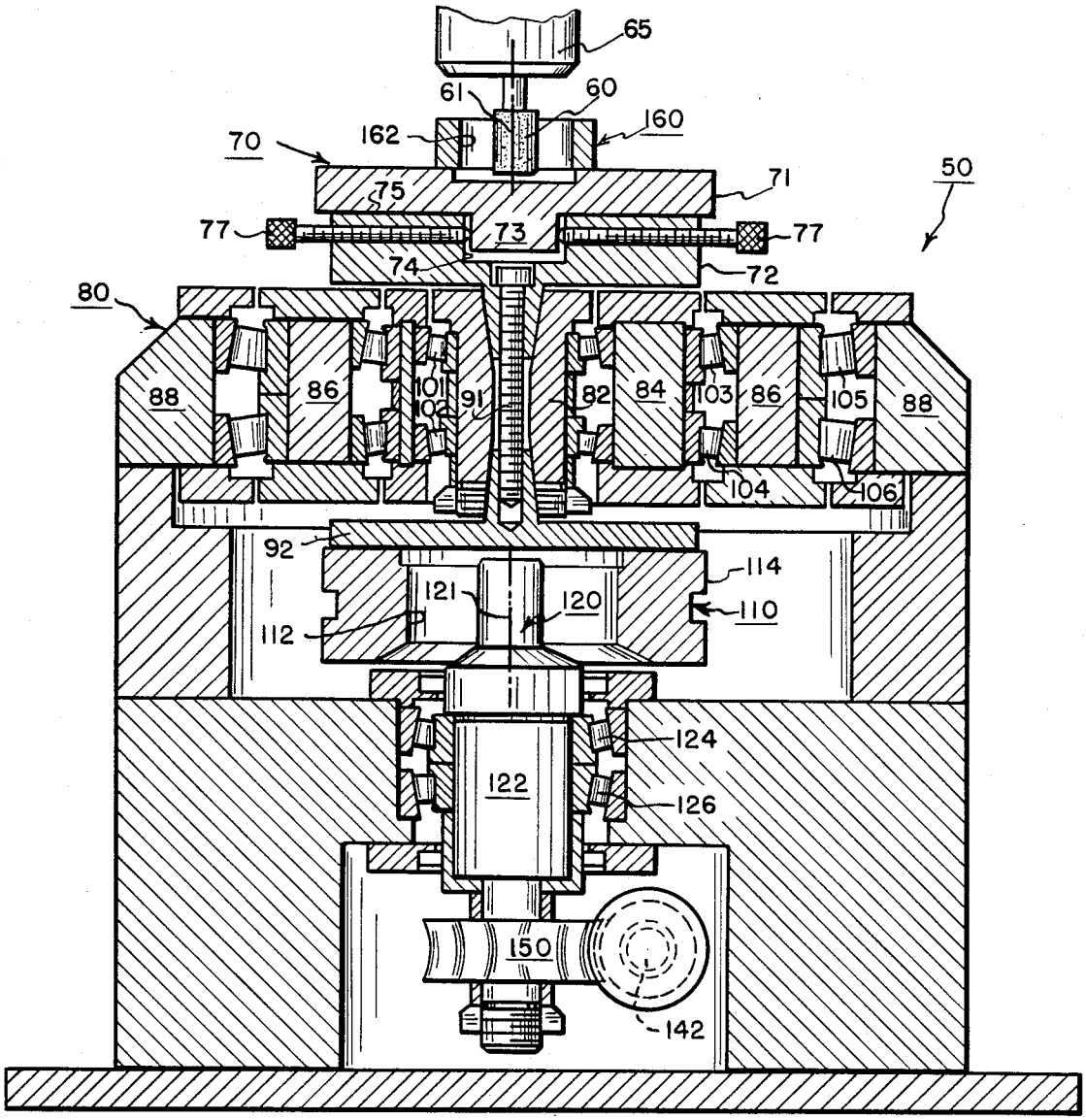
FIG. 2 is a cross-sectional view of the embodiment of FIG. 1 along line 2—2.

A similar cam 1, cam drive follower 2 and cam guide follower means 4 are described in detail in U.S. Pat. No. 3,663,188 which is incorporated herein by reference. As indicated in FIG. 2 of that patent, drive follower 2 and internal surface 3 of the cam are tangent to each other at contact point 11; and a plane P-1 extends through the axis of rotation of drive follower 2 and normal to the surface of the cam at point 11. The axis of rotation of grinding wheel 8 of the '188 patent is likewise located in plane P-1 but is movable therein toward workpiece 9. Similarly, as shown in FIG. 4 of the present specification, internal surface 112 of cam 110 is tangent to drive follower 120 at contact point 111 and a plane P extends through the axis of rotation 121 of drive follower 120 and normal to the surface of the cam. As described in the '188 patent at Col. 4, lines 22 through 43, guide follower means 4 holds cam 1 relative to drive follower 2 so that point 11 remains fixed and the tangent T to the internal surface of the cam at point 11 is always perpendicular to plane P-1. In like fashion, guide follower means 130 of the present specification holds cam 110 relative to drive follower 120 so that point 111 remains fixed and the tangent T to the internal surface of the cam at point 111 is always perpendicular to plane P. If the internal surface of the cam were a cylindrical section, the motion of the cam would be a simple rotation about the axis of the cylinder. Where the surface is non-cylindrical, however, the motion of the cam includes both rotational and lateral movement as the cam moves past the cam drive follower.

A workpiece 160 is mounted on worktable 70 and rigidly secured thereto by clamping means (not shown). In the example shown in FIGS. 1 and 2, an interior surface 162 of the workpiece is being ground by grinding wheel 60 which is driven by motor 65 about an axis of rotation 61. As shown in FIG. 4, axis of rotation 61 lies in plane P that extends through axis of rotation 121 of cam drive follower 120 and point 111 and is perpendicular to the tangent to the internal surface of cam 110 at point 111. Grinding wheel 60 is advantageously mounted by means such as those shown in FIG. 5 of the '188 patent, so that it can be fed into the workpiece along the plane extending through the axis of rotation of the cam drive follower and the point of contact between the cam drive follower and the internal surface of the cam. As a result, the surface being ground will always be perpendicular to plane P. In addition, the grinding wheel advantageously can also be reciprocated vertically by means shown in FIG. 3 of the '188 patent.

Figure 5:
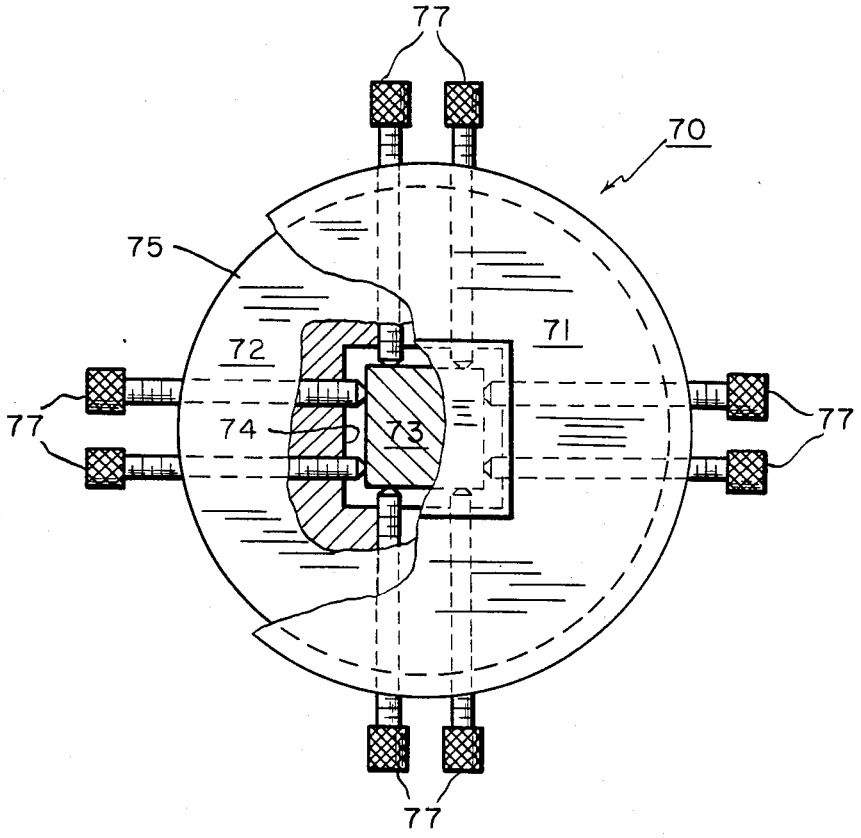
FIG. 5 is a partial cross-sectional view of a preferred embodiment of the worktable of the present invention taken along lines 5—5 of FIG. 1.

The present invention is directed to a worktable that provides for both rotational and lateral movement of the workpiece so that, for example, a machinist may align the workpiece in the proper position so that a tangent to an interior surface of the workpiece is perpendicular to plane P through the axis of rotation 61 of grinding wheel 60 and the point of contact between the grinding wheel and the workpiece. As shown in FIG. 1 of the present specification, worktable 70 comprises upper and lower members 71, 72 that fit together in sliding relation with an extension 73 of the upper member protruding into a recess 74 in the lower member. Recess 74 is larger than extension 73 so as to permit upper member 71 to slide across the surface 75 between the upper and lower members. Adjustment screws 77 are mounted in lower member 72 so as to bear on extension 73 and thereby secure the upper member of worktable 70 in position relative to the lower member. By backing off on some screws while advancing others, the upper member of the worktable may be moved with respect to the lower member to adjust the position of the workpiece with respect to the grinding wheel. Advantageously, as shown in FIG. 5, extension 73 and recess 74 are square in shape and a pair of adjustment screws 77 bear on each surface of extension 73 in opposition to a pair of screws bearing on the opposite surface. The use of pairs of opposing adjustment screws has the advantage of permitting both rectilinear movement of upper member 71 depending on the amount of advancement of each pair of screws and rotational movement when the screws in each pair are advanced by different amounts. By this means, for example, workpiece 160 may first be positioned laterally so that the workpiece intersects the plane P at the point where the grinding wheel contacts the workpiece and the workpiece may then be rotated so that the tangent to its interior surface is perpendicular to the plane P, thereby aligning the workpiece with the cam.

In the illustrative grinding apparatus of FIGS. 1-4, worktable 70 is supported for rotation by support means 80 that comprises a spindle 82 and three annular rings 84, 86, 88. Spindle 82 is rigidly connected to lower member 72 of worktable 70 and to cam member 110 by means of a threaded screw 91 and support plate 92. Worktable member 72 and support plate 92 are locked by pins 93, 94 to maintain a constant orientation relative to one another. Annular ring 88 is rigidly connected to the frame of apparatus 50. Support means 80 further comprises three pairs of upper and lower roller bearing arrays 101, 102, 103, 104, 105, 106 which are disposed between spindle 82 and annular rings 84, 86, 88. As shown in the top plan view of FIG. 3, each roller bearing array is circular but the centers of the three circles defined by the three upper and lower pairs of arrays are not coincident. In particular, the center of arrays 101, 102 and the axis of rotation of spindle 82 is axis 81, the center of arrays 103, 104 and the axis of rotation of annular ring 84 is axis 83, and the center of arrays 105, 106 and the axis of rotation of annular ring 86 is axis 85. As a result, each annular ring 84 and 86 has a variable thickness that changes smoothly from a minimum to a maximum and back to a minimum in 360°. of arc of the annulus.

Spindle 82 rotates within the three nested sets of roller bearing arrays in accordance with the movement imparted to cam member 110 by cam drive follower 120. In addition, because the centers of the three upper and lower pairs of roller bearing arrays are not coincident, the position of the spindle and therefore of the workpiece varies laterally in two dimensions, again in response to the movement imparted to the cam member by the cam drive follower.

As will be apparent to those skilled in the art, the worktable of the present invention may be used with other cam-controlled grinding devices such as those described in the alternative embodiments of the cross-referenced application as well as those described in U.S. Pat. Nos. 3,663,188, 3,800,621 and 3,822,511. It may also be used in numerous other circumstances in which one desires to provide for both rotational and lateral adjustment of one surface relative to another.

What is claimed is:

1. A grinding apparatus for grinding a surface of a workpiece comprising:

a cam member having a surface corresponding to the surface to be ground on the workpiece.

a cam follower engaging the surface of the cam member, means for supporting the workpiece and cam member for movement in accordance with the surface of said cam member, said means comprising:

a worktable to which said workpiece may be secured, said worktable comprising first and second members that fit together in sliding relation with a rectangular extension of one member protruding into a recess in the other member, said recess being large enough to permit in said recess linear movement of said extension in two dimensions and rotational movement about an axis perpendicular to said two dimensions, and at least eight adjustment screws with all of said screws mounted substantially in a single plane in said other member so at least two screws bear on each different side of said extension, whereby the lateral and rotational position of one of said members relative to the other may be varied by adjustment of the position of said adjusting screws, a spindle connected to said cam member and said worktable, and a spindle housing means in which said spindle is mounted for rotation about an axis of said spindle, means for causing relative movement of the cam surface with respect to the cam follower, and grinding means for engaging the surface of the workpiece to be ground as the cam surface moves relative to the cam follower.

2. The apparatus of claim 1 wherein each adjustment screw is opposed by another adjustment screw.

3. A worktable comprising first and second members that fit together in sliding relation with a rectangular extension of one member protruding into a recess in the other member, said recess being large enough to permit in said recess linear movement of said extension in two dimensions and rotational movement about an axis perpendicular to said two dimensions, and at least eight adjustment screws with all of said screws mounted substantially in a single plane in said other member so that at least two screws bear on each different side of said extension, whereby the lateral and rotational position of one of said members relative to the other may be varied by adjustment of the position of said adjusting screws.

4. The worktable of claim 1 wherein each adjustment screw is opposed by another adjustment screw.

* * * * *